US006634819B2

(12) United States Patent
Uchida

(10) Patent No.: US 6,634,819 B2
(45) Date of Patent: Oct. 21, 2003

(54) RECORDING APPARATUS WITH MODULAR HOUSING COMPONENTS

(75) Inventor: Haruo Uchida, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 64 days.

(21) Appl. No.: 09/906,683

(22) Filed: Jul. 18, 2001

(65) Prior Publication Data

US 2002/0021343 A1 Feb. 21, 2002

(30) Foreign Application Priority Data

Jul. 21, 2000 (JP) ..... 2000/221298

(51) Int. Cl.[7] ..... B41J 29/02

(52) U.S. Cl. ..... 400/691; 400/692; 400/693; 347/108

(58) Field of Search ..... 400/691, 692, 400/693; 347/108

(56) References Cited

U.S. PATENT DOCUMENTS 4,616,944 A * 10/1986 Galatha et al. ..... 400/692
4,723,857 A * 2/1988 Yokoi ..... 400/693
4,846,595 A * 7/1989 Kato et al. ..... 400/320
5,774,139 A * 6/1998 Salzer et al. ..... 347/32
5,775,825 A * 7/1998 Hong et al. ..... 400/693
5,831,656 A * 11/1998 Chosa ..... 347/108
6,084,622 A * 7/2000 Sugiura et al. ..... 347/170
6,146,036 A * 11/2000 Kim ..... 400/629
6,364,555 B1 * 4/2002 Kerr ..... 400/691
6,439,787 B1 * 8/2002 Kerr ..... 400/691

* cited by examiner

*Primary Examiner*—Andrew H. Hirshfeld
*Assistant Examiner*—Dave A. Ghatt
(74) *Attorney, Agent, or Firm*—Fitzpatrick, Cella, Harper & Scinto

(57) ABSTRACT

A recording apparatus has a first positioning part positioned on a base chassis, and a second positioning part for positioning a guide shaft for guiding a carriage carrying a recording head for recording images on a transported sheet, both provided on the same face of each of a left side plate and right side plate. A third positioning part for positioning a transporting roller for transporting sheets along a sheet transporting path is provided on at least one of these faces. Thus, a recording apparatus can be provided wherein the precision of the chassis configuration and the rigidity thereof is improved, and parts can be standardized, at low cost.

29 Claims, 12 Drawing Sheets

RECORDING APPARATUS WITH MODULAR HOUSING COMPONENTS

BACKGROUND OF THE INVENTION

1. Field of the Invention

The present invention relates to recording apparatuses for forming images on recording sheets, such as, for example, photocopiers, printers, facsimile apparatuses, and so forth.

2. Description of the Related Art

With regard to conventional recording apparatuses, ink-jet recording apparatuses, for example, have been configured based on a chassis that has integral side plates. The configuration of a conventional ink-jet recording apparatus will be described with reference to FIG. 12.

In FIG. 12, reference numeral 101 denotes a recording head, and 102 denotes a carriage for mounting the recording head 101. Reference numeral 104 is a guide shaft which serves as a guiding member for guiding the motion of the carriage 102 in the directions indicated by the arrow A in the figure, which are the main scanning directions, and 105 denotes a guide rail which is another guiding member for guiding the movement of the carriage 102. Reference numeral 106 denotes a timing belt wound around two pulleys (only one pulley 107 shown in the figure), with part of the timing belt 106 being fixed to the carriage 102.

The pulley 107 is directly linked to a carriage motor M1, enabling the carriage 102 carrying the recording head 101 to be scanned in the directions indicated by the arrow A by driving the carriage motor M1. Reference numeral 108 denotes a scale for indicating the absolute position in the scanning direction of the carriage 102, and 113 denotes a recovery unit for performing discharge recovery processing of the recording head 101.

Reference numeral 114 denotes a transporting roller driven by a transporting motor M2 to transport recording sheets. Reference numeral 115 denotes a pinch roller for abutting the recording sheet against the transporting roller 114 with a spring (not shown), and 116 denotes a pinch roller holder for rotatably supporting the pinch roller 115. Reference numeral 117 denotes a transporting roller gear fixed to one end of the transporting roller 114. The transporting roller 114 is driven by the motive force of the transporting motor M2 being transmitted to the transmitting roller gear 117 via an intermediate gear 118.

Reference numeral 119 denotes a discharging roller gear fixed to a discharging roller (not shown) for discharging recording sheets, upon which images have been formed by the recording head 101, outside of the recording apparatus, wherein the motive force of the transporting motor M2 is transmitted to the discharging roller gear 119 via the intermediate gear 118. Reference numeral 120 denotes an automatic sheet feeding device for loading multiple recording sheets thereupon, and separating and feeding the sheets one at a time.

Next, description will be made regarding the configuration of the chassis.

A pulley (not shown) is rotatably fixed on a main face 109A of the chassis 109, on the side opposite from the carriage motor M1, and the pulley 107. A left side face 109C is configured to be bent from the main face 109A, and the guide shaft 104, scale 108, and transporting motor M2 are positioned and fixed thereto. Also, the transporting roller 114 and discharging roller (not shown) are rotatably positioned and fixed by bearings (not shown).

A right side face 109B opposite to left side face 109C, also is configured to be bent away from the main face 109A, and the guide shaft 104 and scale 108 are positioned and fixed thereto. Also, a middle side face 109D also is configured to be bent away from the main face 109A, and the transporting roller 114 and the discharging roller (not shown) are rotatably positioned and fixed by bearings (not shown). The side faces 109B, 109C, and 109D are linked and fixed by being screwed to a separate linking chassis 141, thereby exhibiting precision and rigidity.

The recovery unit 113 is positioned and fixed to the main face 109A, right side face 109B, and middle side face 109D. Also, a first sheet guide member (not shown) for guiding recording sheets fed from the automatic sheet feeding device 120 to the nipping portion between the transporting roller 114 and pinch roller 115, a platen 128 which is a second sheet guiding member for holding recording sheets between the transporting roller 114 and the discharging roller (not shown), and a third sheet guiding member (not shown) for holding the recording sheets at the time of discharging the recording sheets from the discharging roller out from the main unit, are positioned and fixed to the left side plate 109C and the middle side plate 109D.

However, there have been the following problems with conventional recording apparatuses.

With conventional recording apparatuses, the sheet guide member becomes long in the width direction of the recording medium, which raises costs. Also, there has been a problem that the dimensions of the sheet guide member differ at positions close to the attachment parts of the side plates 109C and 109D as compared to that at the center part, due to bowing of the sheet guide member in the width direction. These are not currently problematic, but in the event that images are to be recorded with higher precision than what is currently being performed, there is the possibility that sheet transporting may be unstable, or the distance between the recording head and the recording face of the recording sheet may not be uniform, to a point of not being negligible.

As measures against these problems, increasing the precision of the dimensions for preventing bowing of the sheet guide member has been proposed, but there is a limit to how far precision can be improved, and also increased precision further increases costs. Another proposed arrangement involves forming another side plate by bending from the main face 109A between the left side plate 109C and middle side plate 109D. This configuration has been effective against bowing by reducing the width-wise direction of the sheet guide member, but the effects of bowing of the sheet guide member between the side plates still remain, and the problem was not solved by this arrangement.

Also, another proposed arrangement involves positioning the sheet guide member relative to the transporting roller 114 and the discharging roller (not shown). This is a good configuration from the perspective of precisely positioning the sheet guide member in the width direction by configuring positioning parts at multiple positions in the width direction for the sheet guide member relative to a transporting roller and discharging roller with high rigidity and straightness, but in order to configure a positioning part at the transporting area of the recording sheet, there has been a need to form an outer circumference part smaller than the outer circumference of the transporting roller 114 (i.e., the recording sheet transporting face) and configure a positioning part there. In the event that the transporting roller 114 is a metal roller, this requires a grinding process for configuring the portion with a smaller outer circumference, which leads to great increases in costs for forming the roller. Also, the rigidity decreases, which leads to a problem in that the transporting roller 114 arches more readily.

Also, another problem is that, in shipping, the required space for the chassis 109 is great since the chassis 109 comprises side plates 109B, 109C, and 109D, bent from the main face 109A, so the packing efficiency is poor, leading to increased transporting and handling management costs. Also, the edges of the side plates 109B, 109C, and 109D are long and unstable, so other members are necessary for protecting these parts, further increasing costs.

Also, the positions of the side plates 109B, 109C, and 109D relative to the main face 109A, and the relative positions of the side plates 109B, 109C, and 109D amongst themselves are determined by precision in the bending process, so there has been the problem that high precision is not readily attained, leading to problems such as low yield and increased costs in working machinery for increasing precision, and so forth.

Also, as another problem, linking the chassis 109 and linkage chassis 141 by the side plates 109B, 109C, and 109D generates rigidity of the overall chassis, but the side plates 109B, 109C, and 109D are formed by bending portions of the main face 109A, so while the rigidity is high in the event that a sufficient bending range is obtained, rigidity deteriorates in the event that sufficient bending range cannot be obtained, as with the middle side plate 109D. Also, the bent portions of side plates 109B and 109*c* may be reduced in the event that attaching portions for parts need to be formed around the bent portions, leading to a problem that further supporting members are required.

Also, as yet another problem, plates 109A, 109B, 109C, and 109D are integrally formed, so the chassis 109 must be redesigned to alter the length of the main face 109A for products in which the sheet width is different. Also, the chassis 109 must be redesigned for products in which the driving system for transporting is different, and products in which the form of the side faces 109B and 109C is modified due to changes in the main scanning system. Accordingly, there has been a need for reduction in the cost of parts, assembly, and management, with regard to standardization of parts between models, and making a series of products, and handling improved versions of products, etc., has been difficult.

SUMMARY OF THE INVENTION

The present invention provides a recording apparatus capable of realizing improved precision and rigidity of the chassis configuration, and standardization of parts between models, at low cost.

To this end, a recording apparatus for recording on a recording medium with a recording head, comprises: a base chassis; transporting means for transporting the recording medium; head mounting means for mounting the recording head; holding means for holding the head mounting means; two side plates connected to opposite ends of the base chassis across a transporting path for transporting the recording medium; first positioning parts, disposed on a predetermined face of each of the two side plates, for positioning the side plates on the base chassis; second positioning parts, disposed on the predetermined face of each of the two side plates, for positioning the holding means on the side plates; and a third positioning part, disposed on one of the two side plates, for positioning the transporting means on at least one of the side plates.

Further objects, features and advantages of the present invention will become apparent from the following description of the preferred embodiments (with reference to the attached drawings).

DESCRIPTION OF THE PREFERRED EMBODIMENTS

The preferred embodiments of the present invention will now be described in detail with examples, with reference to the attached drawings. Note, however, that the dimensions, materials, forms, and relative placements of the components described in these embodiments may be changed as appropriate according to the configuration of the apparatus to which the present invention is to be applied and other various conditions, and are not to be understood as restricting the scope of the present invention.

First Embodiment

Figure 1:
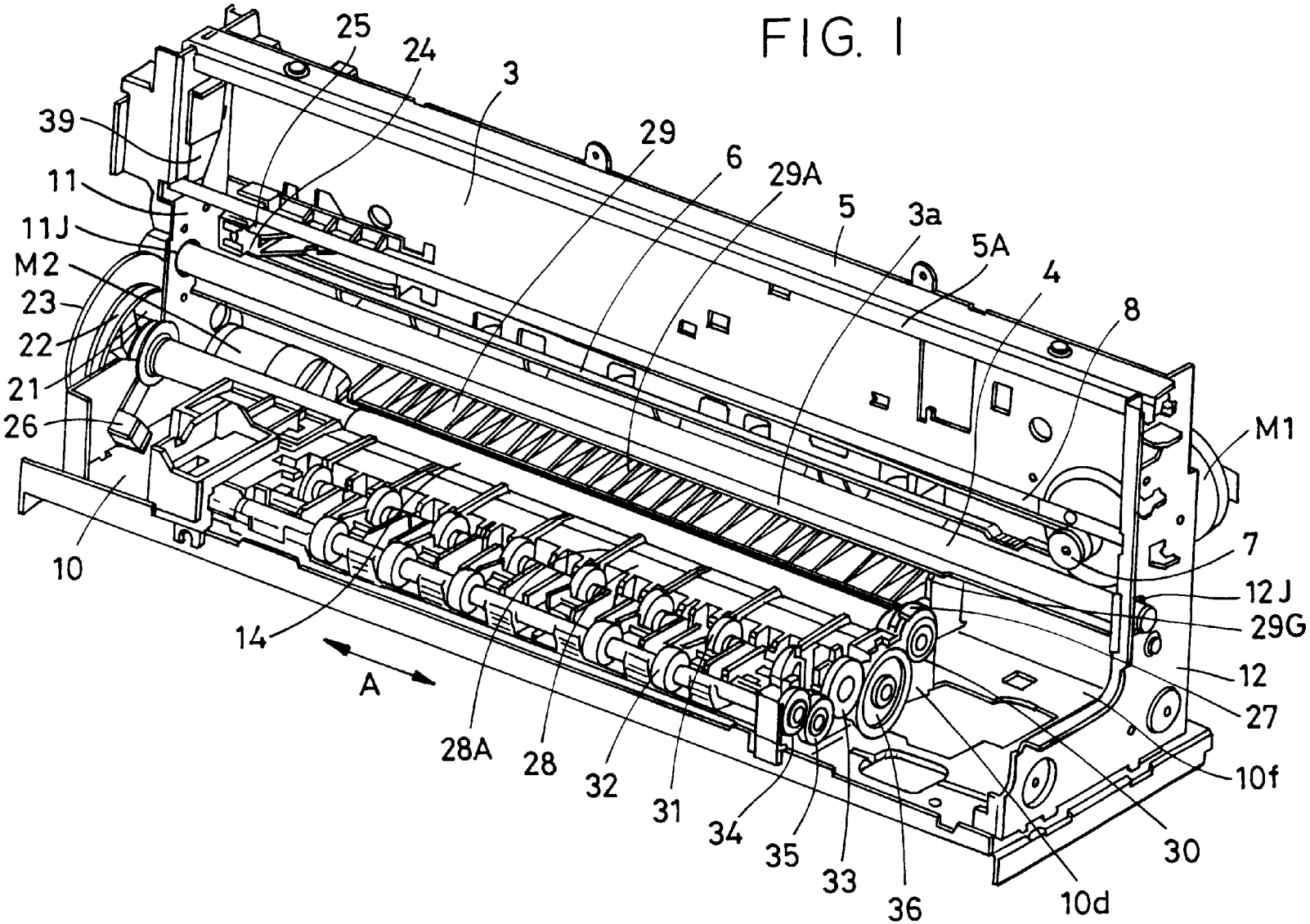
FIG. 1 is a perspective view of an image recording apparatus main unit according to a first embodiment, viewed from the right side.
Figure 2:
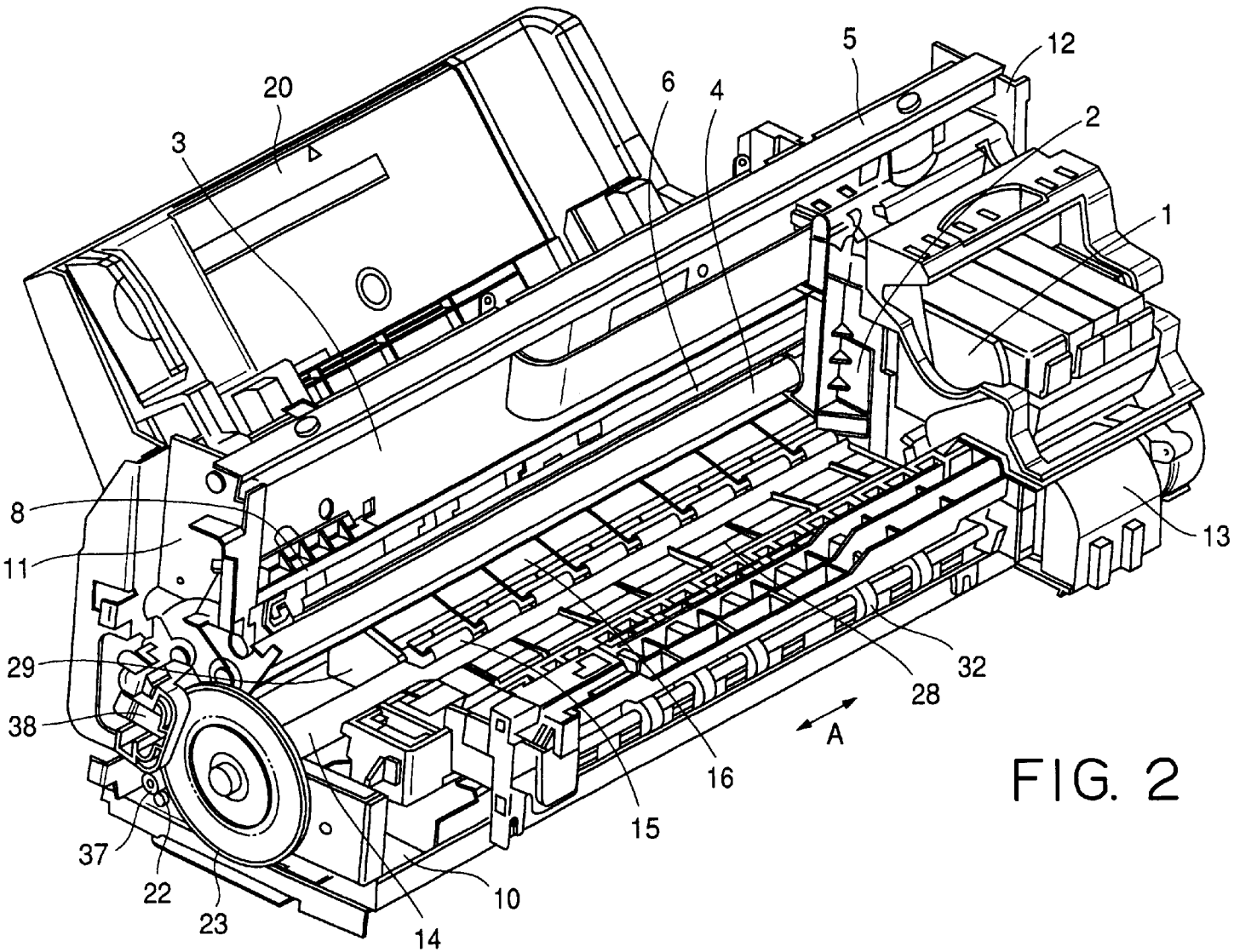
FIG. 2 is a perspective view of the image recording apparatus main unit according to the first embodiment, viewed from the left side.
Figure 3:
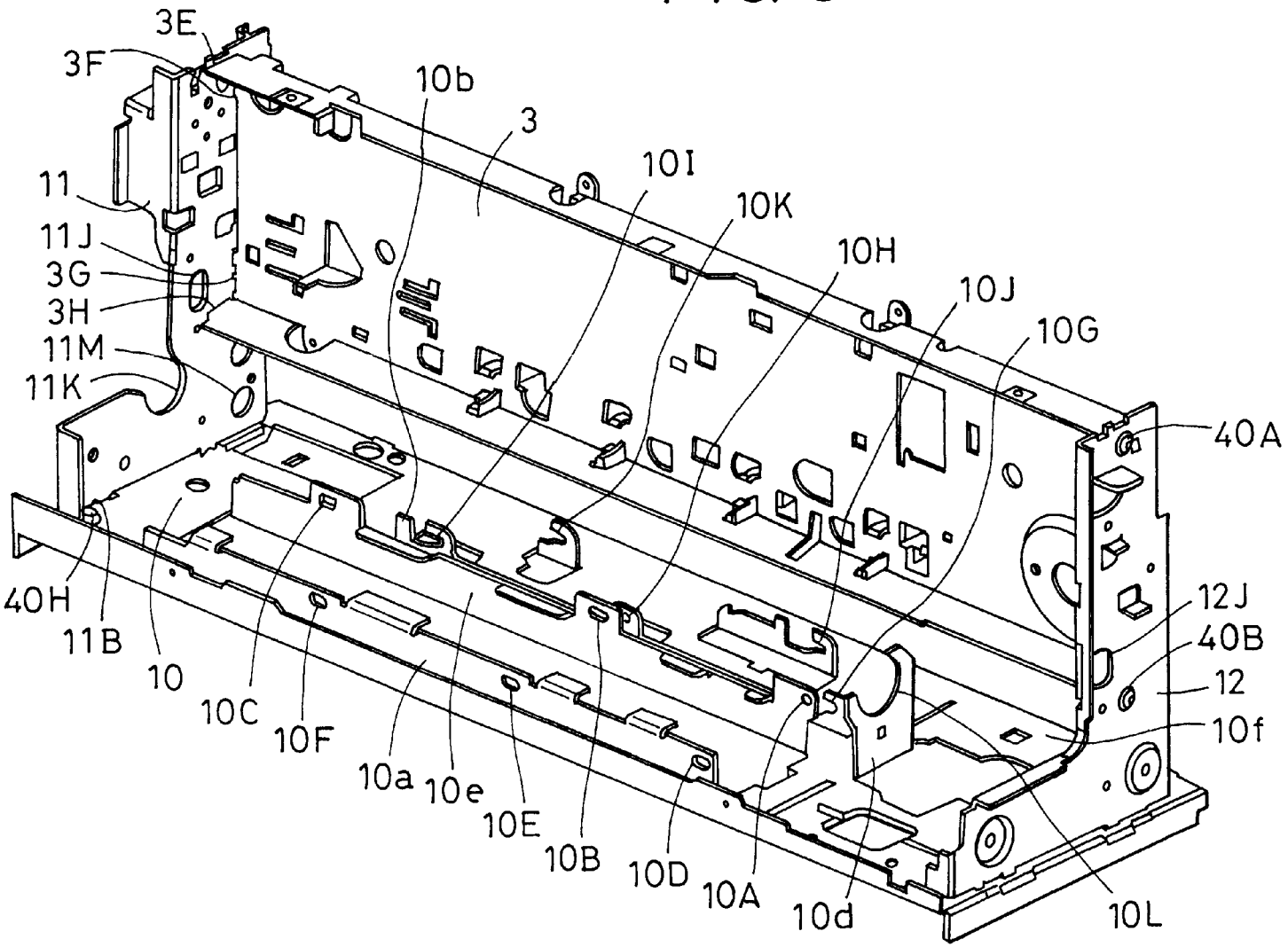
FIG. 3 is a perspective view of a chassis unit according to the first embodiment, viewed from the right side.
Figure 7:
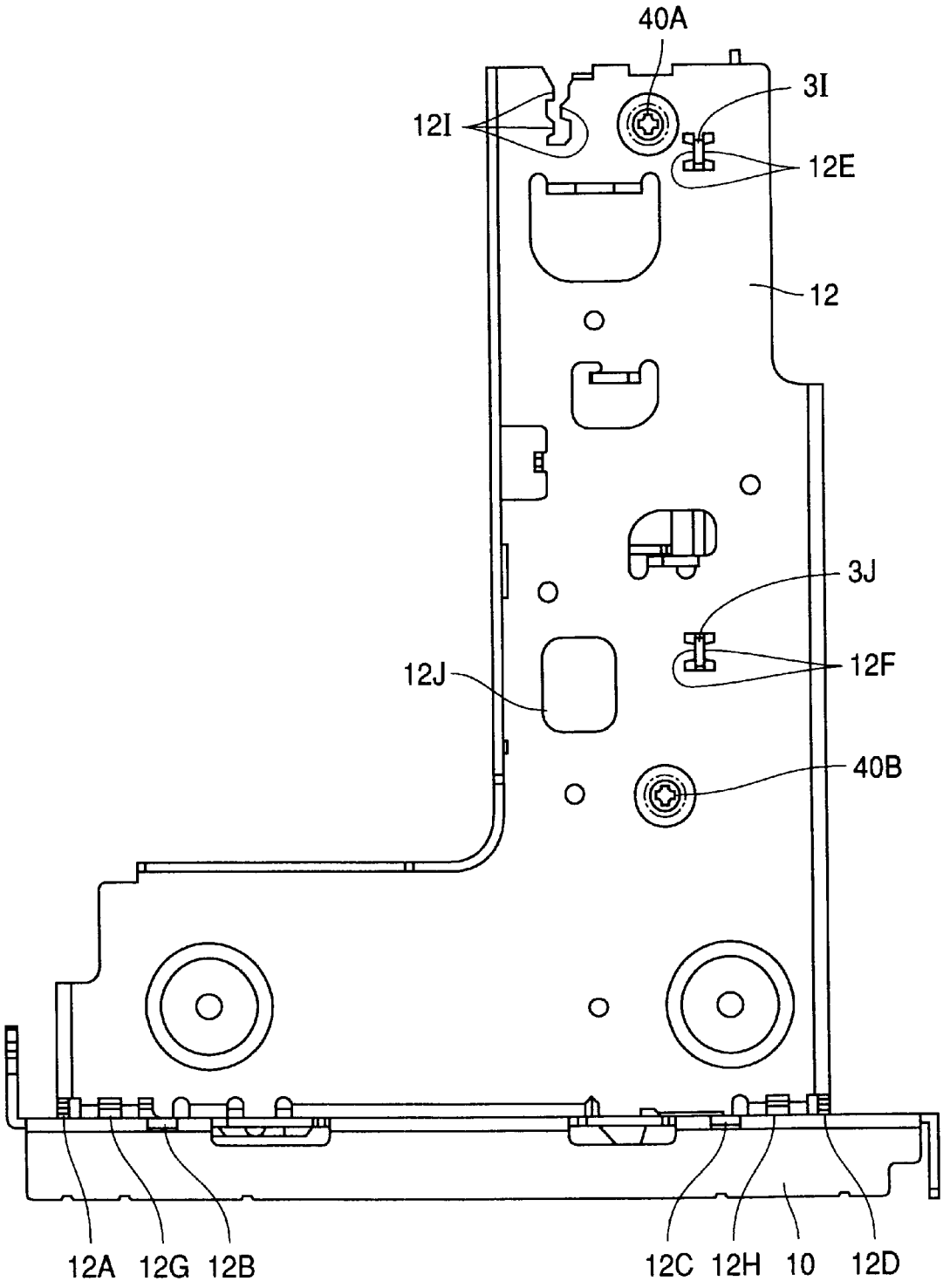
FIG. 7 is a right side view of the chassis unit according to the first embodiment.
Figure 8:
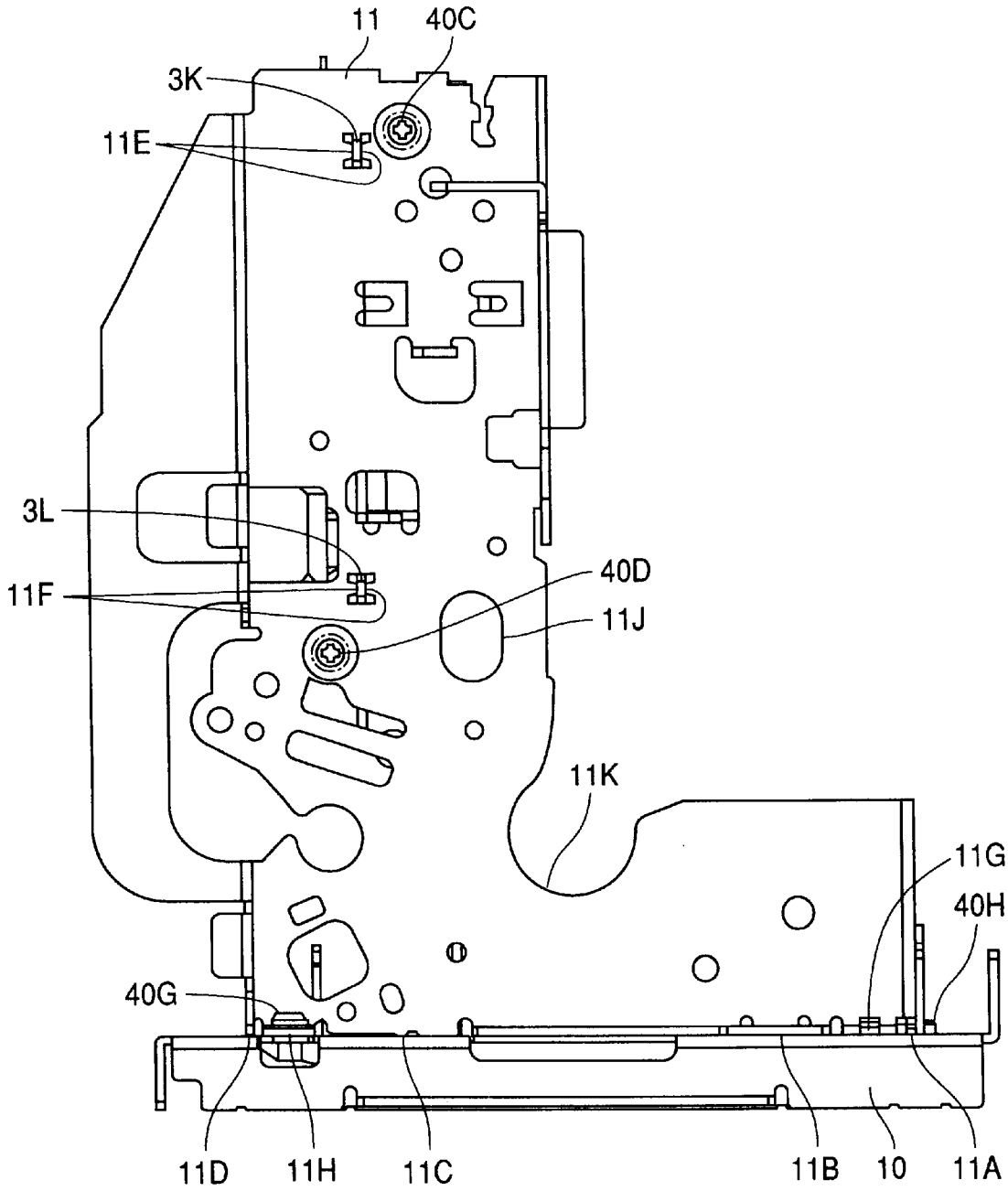
FIG. 8 is a left side view of the chassis unit according to the first embodiment.
Figure 9:
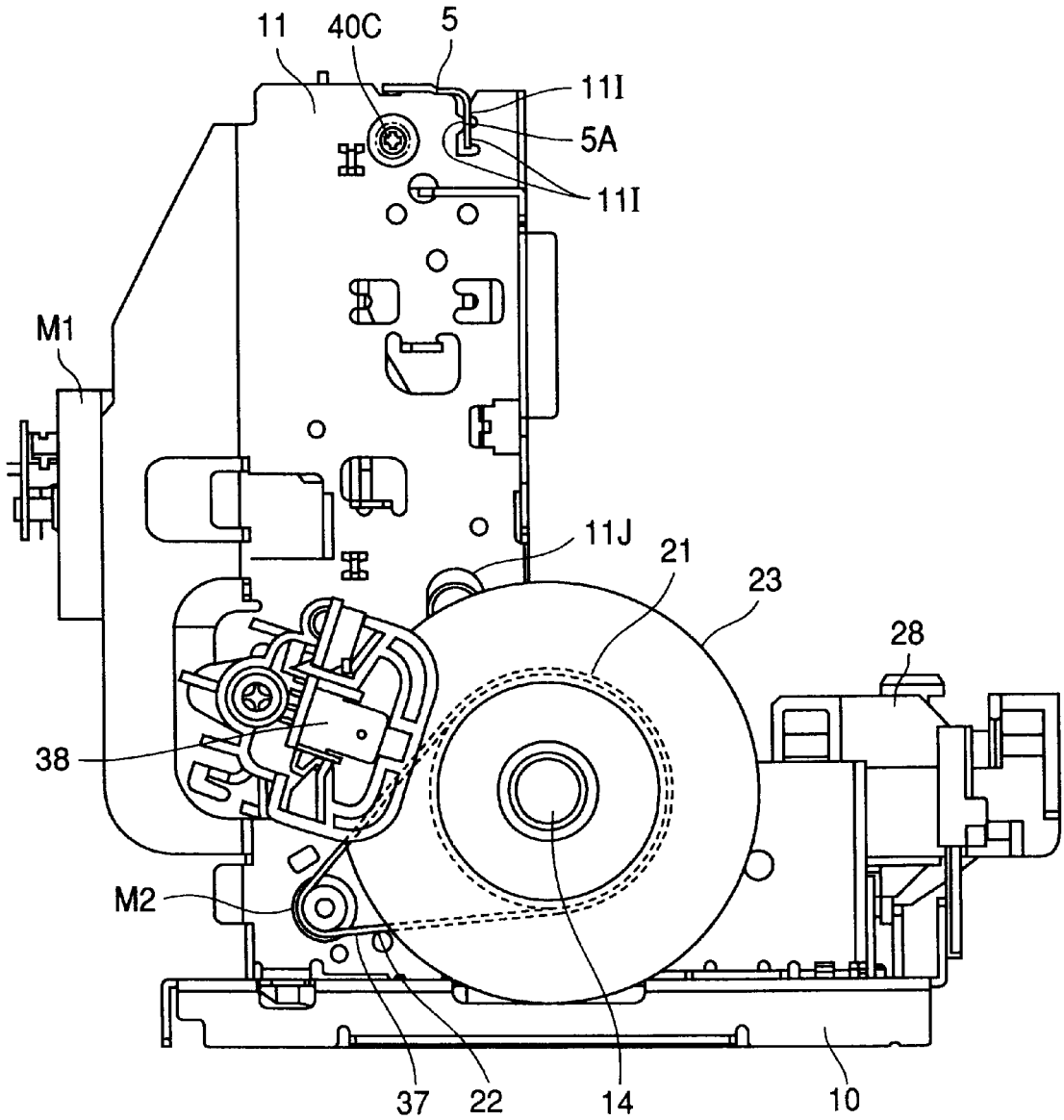
FIG. 9 is a left side view of an apparatus main unit according to an embodiment.

An image recording apparatus according to a first embodiment will be described with reference to FIGS. 1 through 3 and 7 through 9. FIG. 1 is a perspective view of the entire image recording apparatus excluding the carriage unit, recovery unit, and automatic feeding unit, viewed from the right side; FIG. 2 is a perspective view of the entire image recording apparatus, viewed from the left side; FIG. 3 is a perspective view of a chassis unit, viewed from the right side; FIG. 7 is a right side view of the chassis unit; FIG. 8 is a left side view of the chassis unit; and FIG. 9 is a left side view of the image recording apparatus.

Reference numeral 1 denotes a recording head, 2 denotes a carriage for mounting the recording head 1, and 4 denotes a guide shaft which is a guiding member for guiding the carriage 2 in the directions of the arrow A shown in the figure. The right side of the guide shaft 4 is fixed to a right side plate 12 by a positioning hole 12J, serving as a positioning part as shown in FIG. 7. The left side of the guide shaft 4 is positioned and fixed to a left side plate 11 by a positioning hole 11J, also serving as a positioning part, as shown in FIGS. 8 and 9. Also, an arrangement may be made wherein the guide shaft 4 is positioned in the sheet transporting direction by positioning holes 11J and 12J, and the height direction of the guide shaft 4 is positioned by a separate mechanism.

Reference numeral 5 denotes a guide rail which is another guiding member for guiding the carriage 2, and guides movement of the carriage 2 on the rear side of main face 5A. The right side of the guide rail 5 is positioned on the right side plate 12 by a positioning part 12I shown in FIG. 7. The left side of the guide rail 5 is positioned on the left side plate 11 by a positioning part 11I shown in FIG. 9.

Reference numeral 6 is a timing belt wound around a motor pulley 7 and an idler pulley 25, disposed at opposite sides thereof, and a part of timing belt 6 is fixed to the carriage 2.

The motor pulley 7 is directly linked to a carriage motor M1 serving as a driving source for moving the carriage 2. The carriage motor M1 is positioned and fixed to a chassis 3. Driving carriage motor M1 allows the carriage 2 carrying the recording head 1 to be scanned in the directions of the arrow A shown in the figure.

The idler pulley 25 is rotatably positioned and held by a pulley holder 24. The pulley holder 24 is positioned and fixed to the chassis 3 in a state of the timing belt 6 being tensioned by an elastic member (not shown).

Reference numeral 8 denotes a scale indicating an absolute position of the carriage 2 in the scanning direction, and reference numeral 39 denotes a scale tensioning spring for providing tension to the scale 8. The right side of the scale 8 is positioned and fixed to the right side plate 12, and the scale tensioning spring 39 attached to the left side of the scale 8 is positioned and fixed to the left side plate 11. The relative position between the carriage 2 and scale 8 can be positioned with high precision. Also, the position of the scale 8 in the height direction is restricted by the left side plate 11.

Reference numeral 13 denotes a recovery unit for performing discharging recovery processing for the recording head 1, and comprises a cleaning unit (not shown) for cleaning the head face of the recording head 1, a capping unit (not shown) comprising a sealing system for the discharge portion of the recording head 1, and so forth. The recovery unit 13 is positioned and fixed to a base chassis 10.

Reference numeral 14 denotes a transporting roller serving as a sheet transporting rotating member for transporting recording sheets, 15 denotes a pinch roller for urging the recording sheets against the transporting roller 14 by a spring (not shown), and 16 denotes a pinch roller holder for rotatably supporting the pinch roller 15.

Reference numeral 21 denotes a transporting roller pulley fixed to one end of the transporting roller 14, and the driving force of the transporting motor M2 is transmitted to the transporting roller pulley 21 by way of a timing belt 22 wound around the transporting roller pulley 21 and a motor pulley 37 of the transporting motor M2 serving as a transporting driving source.

Further, a scale 23 for detecting the rotational position of the transporting roller 14 is attached to the end portion of the transporting roller 14, for detecting the amount of rotation of the transporting roller 14 by a position detecting part 38 positioned and fixed to the left side plate 11.

As shown in FIGS. 1 and 3, the right side of the transporting roller 14 is rotatably positioned in a positioning part 10L of a bent face 10d of the base chassis 10, via a bearing 27 serving as a transporting holding member. The left side of the transporting roller 14 is rotatably positioned in a positioning part 11K of the left side plate 11, via a bearing 26 serving as a transporting holding member. Also, the transporting motor M2 is a DC motor, and is positioned and fixed to a positioning part 11M of the left side plate 11.

Reference numeral 31 is a first discharging roller serving as a sheet discharging rotating member for transporting recording sheets upon which images have been formed by the recording head 1, and 32 denotes a second discharging roller for discharging recording sheets out from the recording apparatus.

The first discharging roller 31 and the second discharging roller 32 are rotatably positioned and held by a second sheet guide member 28 for guiding recording sheets between the transporting roller 14 and the first discharging roller 31. The recording sheets are guided by multiple sheet guiding ribs 28A, thereby being transporting while maintaining a predetermined height. The second sheet guide member 28 is positioned and fixed to a further positioning part of the base chassis 10, described later.

Driving gears 33 and 34 are fixed to the ends of the first discharging roller 31 and the second discharging roller 32, respectively. Also, the first discharging roller 31 and the second discharging roller 32 are rotatably held by the second sheet guide member 28 in the state that driving idler gears 35 and 36 are meshed with the driving gears 33 and 34. A discharging driving gear 30 is fixed at the end of the transporting roller 14, meshes with a discharging idler gear 36, and transmits the driving force to the discharging rollers 31 and 32.

Reference numeral 20 denotes an automatic sheet feeding device for loading multiple recording sheets thereupon, and separating and feeding the sheets one at a time. Recording sheets fed from the automatic sheet feeding device 20 are guided to a pinch roller holder 16 and multiple sheet guide ribs 29A of a first sheet guide member 29, and are transported to the nipping part between the transporting roller 14 and pinch roller 15. The first sheet guide member 29 is positioned and fixed to the sixth positioning part of the base chassis 10, described later, as with the second sheet guide member.

Figure 10:
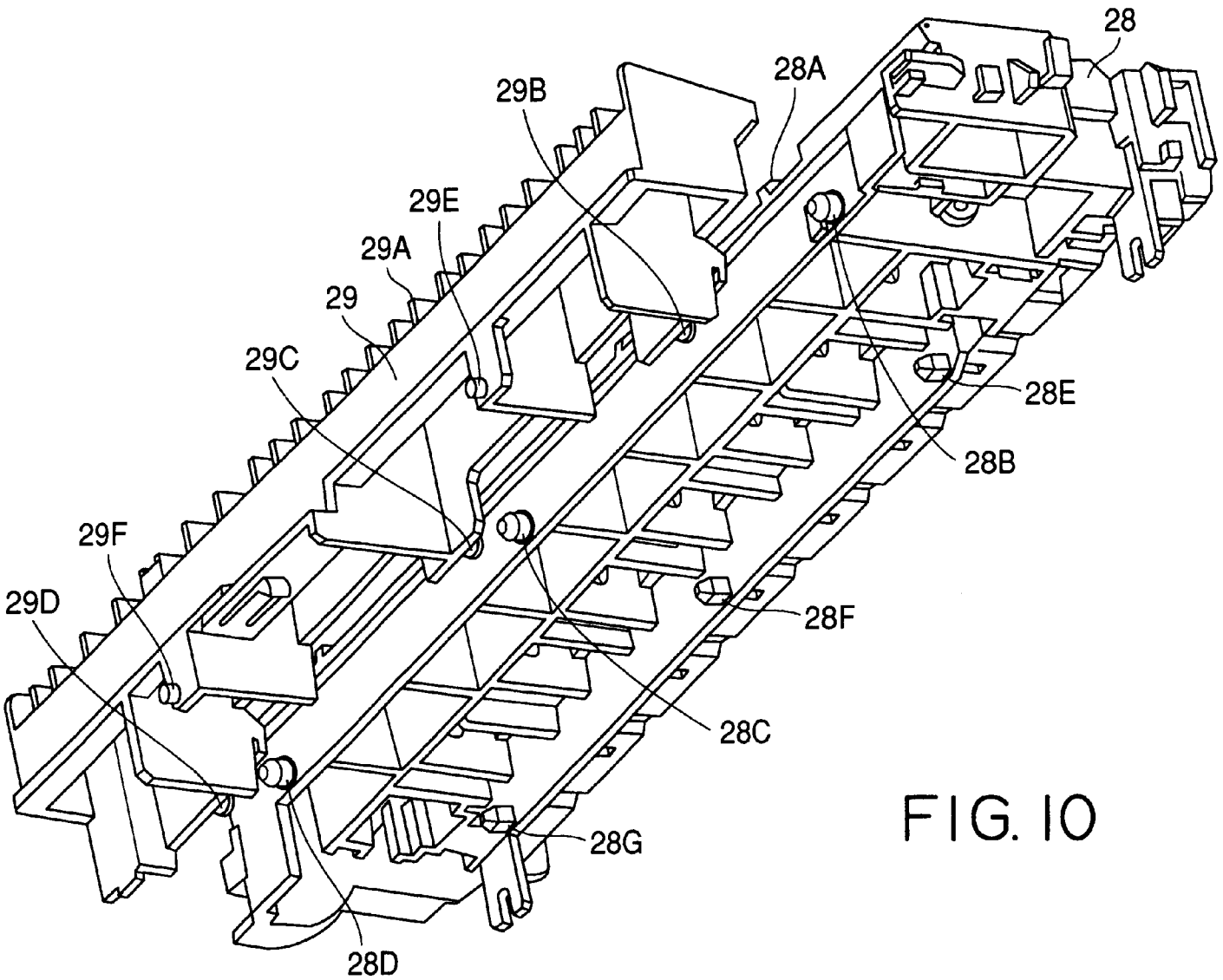
FIG. 10 is a perspective view of a sheet guide unit according to the first embodiment.

Next, with reference to FIGS. 3 and 10, description will be made of the configuration for positioning the first sheet guide member 29 and the second sheet guide member 28 to the base chassis 10, with the aforementioned further positioning part.

First, a positioning part 29D of the first sheet guide member 29 is positioned in the vertical direction by a positioning part 10G of the base chassis 10. In the same manner, positioning part 29C is positioned by positioning part 10H, 29B by 10I, 29F by 10J, and 29E by 10K, respectively. Thus, a portion of first sheet guide member 29 near the nipping part between the transporting roller 14 and pinch roller 15 is positioned by three points in the width direction of the recording sheet, so the height of the first sheet guide member 29 relative to the nipping part between the transporting roller 14 and pinch roller 15 is positioned with high precision, and in a stable state.

Also, positioning on the base chassis 10 formed of a metal plate with high rigidity allows stable positioning to be maintained even in the event that the first sheet guide member 29 does not have rigidity. Also, even in the event that the first sheet guide member 29 bows, positioning on the base chassis 10 allows the bowing to be corrected and precise positioning to be performed. Further, forming the three positioning parts on the same bent face 10*b* allows the relative positional precision between the positioning parts to be improved. As described above, positioning parts 10G through 10K on the base chassis function as a positioning part for positioning the first sheet guide part 29 onto the base chassis 10.

In the same manner, with the second sheet guide member 28, positioning part 28D is positioned by positioning part 10A, 28C by 10B, 28B by 10C, 28G by 10D, 28F by 10E, and 28E by 10F, respectively. Also, three points are positioned on each of the same bent faces 10*a* and 10*e*. Thus, the height of the sheet guide ribs 28A is positioned with high precision in the width direction of the recording sheet in a stable manner. Accordingly, the distance in the recording area between the head face of the recording head and the recording face of the recording sheet can be maintained constant in the width direction of the recording sheet. Other advantages thereof are the same as those with respect to the first sheet guide member 29. As described above, positioning parts 10A through 10F on the base chassis 10 function as the positioning part for positioning the second sheet guide part 28 onto the base chassis 10.

Figure 4:
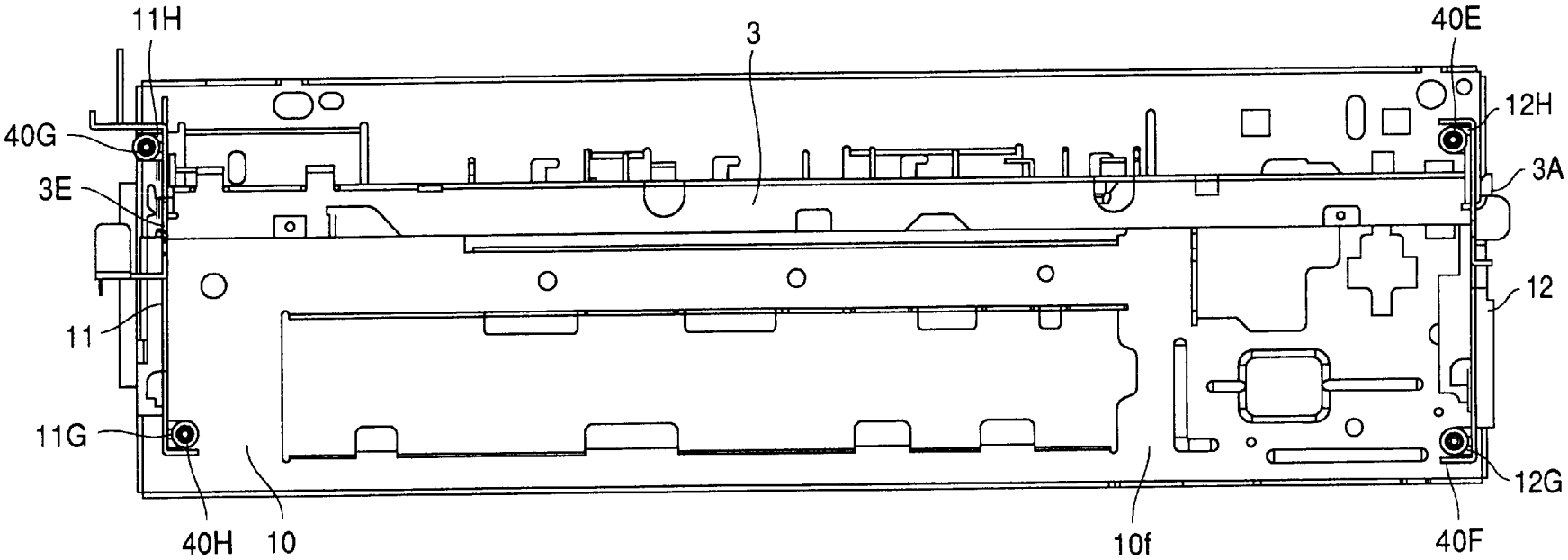
FIG. 4 is a top plan view of the chassis unit according to the first embodiment.
Figure 5:
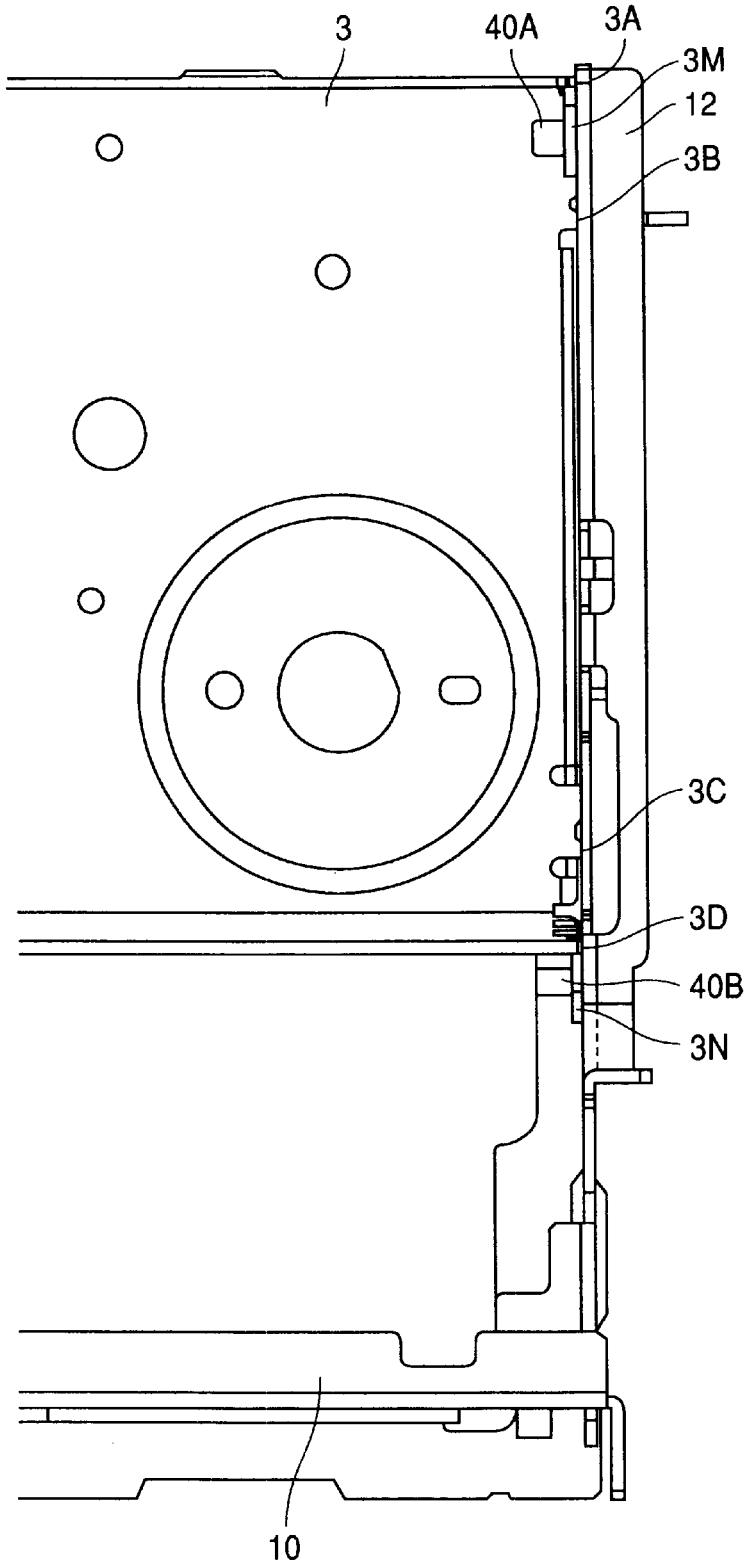
FIG. 5 is a right-side enlarged view of the chassis unit according to the first embodiment, viewed from the front.
Figure 6:
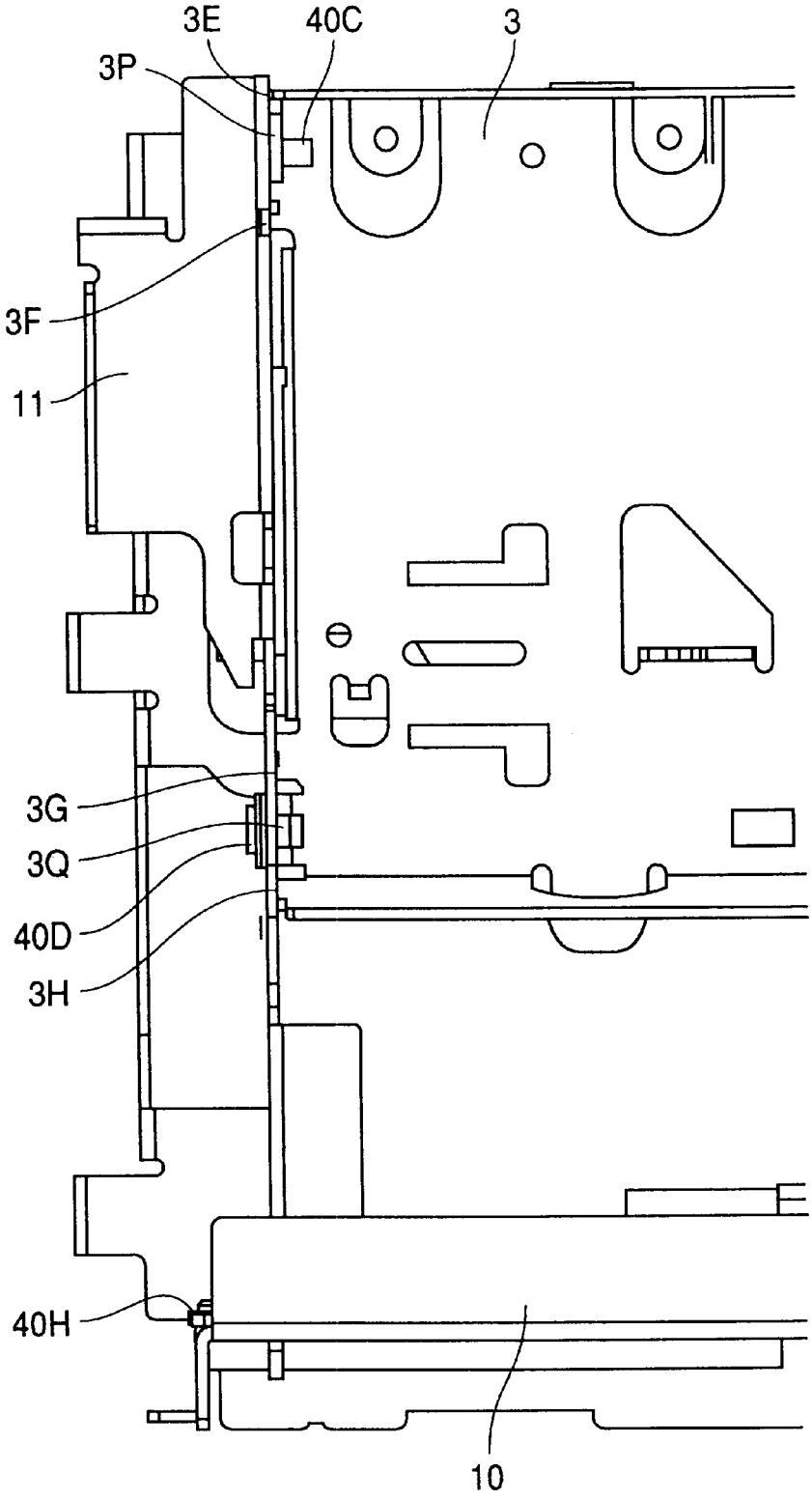
FIG. 6 is a left-side enlarged view of the chassis unit according to the first embodiment, viewed from the front.

Next, the configuration of the chassis will be described with reference to FIGS. 3 through 8. FIG. 4 is a top plan view of the chassis unit, FIG. 5 is a right-side enlarged view of the chassis unit viewed from the front, and FIG. 6 is a left-side enlarged view of the chassis unit viewed from the front.

The configuration for positioning the chassis 3 and the right side plate 12 at the corresponding positioning part will be described with reference to FIG. 7. A positioning part 3I of the chassis 3 is positioned in a positioning hole 12E of the right side plate 12. In the same manner, a positioning part 3J is positioned in a positioning hole 12F. Thus, the right side plate 12 is positioned in the vertical direction and recording sheet transporting direction, relative to the chassis 3. As described above, the positioning holes 12E and 12F of the side plate 12 serve as a positioning part for positioning the chassis 3 relative to the right side plate 12.

Next, description will be made regarding positioning in the width direction. As shown in FIGS. 4, 5, and 7, positioning protrusions 3A, 3B, 3C, and 3D of the chassis 3 abut against the face of the right side plate 12 to perform positioning. There is provided a screw hole in a screw fixing bent part 3M of the chassis 3, and a screw 40A is fixed to the part 3M with the right side plate 12 held thereby. Thus, the positioning parts 3A and 3B are drawn toward the right side plate 12 by tightening the screw 40A, and are positioned and fixed in the state of abutting against the right side plate 12.

In the same manner, fixing and tightening a screw 40B to a screw fixing bent part 3N causes the positioning parts 3C and 3D to be drawn toward the right side plate 12, and to be positioned and fixed in the state of abutting against the right side plate 12.

As shown in FIGS. 4, 6, and 8, positioning between the chassis 3 and the left side plate 11 is carried out in the same manner. A positioning part 3K of the chassis 3 is positioned in a positioning hole 11E of the left side plate 11. In the same manner, a positioning part 3L is positioned in a positioning hole 11F. Thus, the left side plate 11 is positioned in the vertical direction and recording sheet transporting direction, relative to the chassis 3. As described above, the positioning holes 11E and 11F of the left side plate 11 serve as a positioning part for positioning the chassis 3 relative to the left side plate 11.

Also, positioning protrusions 3E, 3F, 3G, and 3H of the chassis 3 are abutted against the face of the left side plate 11 to perform positioning.

There is provided a screw hole in a screw fixing bent part 3P of the chassis 3, and a screw 40C is fixed to the 3P part with the left side plate 11 held thereby. Thus, the positioning parts 3E and 3F are drawn toward the left side plate 11 by tightening the screw 40C, and are positioned and fixed in the state of abutting against the left side plate 11.

In the same manner, fixing and tightening a screw 40D to a screw fixing bent part 3Q causes the positioning parts 3G and 3H to be drawn toward the left side plate 11, and to be positioned and fixed in the state of abutting against the left side plate 11.

Next, description will be made regarding the positioning configuration between the right side plate 12 and the base chassis 10 at a corresponding positioning part, with reference to FIGS. 4, 5, and 7. The positioning configuration is the same as that of the chassis 3 and the right side plate 12 and left side plate 11, with positioning parts (not shown) at two plates on the right side plate 12 being positioned relative to two positioning holes (not shown) of the base chassis 10. Accordingly, the right side plate 12 is positioned in the recording sheet transporting direction and width direction, relative to the base chassis 10.

Next, description will be made regarding positioning the right side plate in the vertical or height direction. Positioning is performed by abutting positioning protrusions 12A, 12B, 12C, and 12D on the right side plate 12 against the face of the base chassis. There is provided a hole in a screw fixing bent part 12G of the right side plate 12, and a corresponding screw hole (not shown) in the base chassis 10, and a screw 40F is fixed to the screw hole (not shown) in the base chassis 10 with the screw fixing bent part 12G of the right side plate 12 being held thereby. Thus, the positioning parts 12A and 12B are drawn toward the base chassis 10 by tightening the screw 40F, and are positioned and fixed in the state of abutting against the base chassis 10.

In the same manner, fixing and tightening a screw 40E in a screw hole (not shown) in the base chassis 10 via a screw fixing bent part 12H causes the positioning parts 12C and 12D to be drawn toward the base chassis 10, and to be positioned and fixed in the state of abutting against the base chassis 10. As described above, the abutting positioning protrusions 12A, 12B, 12C, and 12D of the right side plate 12 serve as positioning parts for positioning the right side plate 12 against the base chassis 10.

Next, as shown in FIGS. 4, 6, and 8, the positioning configuration of the left side plate 11 and the base chassis 10 is also such wherein two positioning parts (not shown) on the left side plate 11 are positioned relative to two positioning holes (not shown) in the base chassis 10. Accordingly, the left side plate 11 is positioned in the recording sheet transporting direction and width direction, relative to the base chassis 10.

Next, description will be made regarding positioning the left side plate in the vertical or height direction. Positioning is performed by abutting positioning protrusions 11A, 11B, 11C, and 11D on the left side plate 11 against the face of the base chassis 10. There is provided a hole in a screw fixing bent part 11G of the left side plate 11, and a corresponding screw hole (not shown) in the base chassis 10, and a screw 40H is fixed to the screw hole (not shown) in the base chassis 10 with the screw fixing bent part 11G of the left side plate 11 held thereby. Thus, the positioning parts 11A and 11B are drawn toward the base chassis 10 by tightening the screw 40H, and are positioned and fixed in the state of abutting against the base chassis 10.

In the same manner, fixing and tightening a screw 40G in a screw hole (not shown) in the base chassis 10 via a screw fixing bent part 11H causes the positioning parts 11C and 11D to be drawn toward the base chassis 10, and to be positioned and fixed in the state of abutting against the base chassis 10. As described above, the abutting positioning protrusions 11A, 11B, 11C, and 11D of the left side plate 11 serve as positioning parts for positioning the left side plate 11 against the base chassis 10.

According to the above configuration, the positioning parts of the chassis 3, base chassis 10, right side plate 12, and left side plate 11, mutually abut one another when fixed by screws, and are linked and fixed in a box-like shape with no slack or looseness, so the rigidity of the chassis unit is improved. Also, the positioning parts of the side plates as to the chassis 3, the positioning parts thereof as to the base chassis 10 which has positioning parts for the first sheet guide member 29, the second sheet guide member 28, the transporting roller 14, and the recovery unit 13, the positioning parts of the guide shaft 4 and guide rail 5 which guide the movement of the carriage 2, the positioning parts of the scale 8 and scale tensioning spring 39, and transporting roller 14, are configured on the same faces of the side plates, so the scanning-related parts and recording sheet transporting-related parts can be precisely relatively positioned.

Also, the side plates can be separated from the base chassis and the chassis, so for products that accommodate different sheet widths, different chassis and base chassis that vary in the sheet width direction can be interchanged, and the side plates can be standardized. Also, in the event that the driving systems for sheet feeding are different, the chassis and base chassis can be standardized by replacing only the side plates, thereby realizing reduction in the cost of parts, assembly, and management, with regard to standardization of parts between models, making a series of products, and handling improved versions of products, with few parts being changed. Also, parts packing and shipping efficiency is improved by dividing the parts, so transporting and handling management costs can be reduced. Also, abutting, linking and fixing the chassis and base chassis with side plates enables the rigidity of the overall chassis to be improved with a simple configuration.

Second Embodiment

The first embodiment has been described with regard to a configuration wherein screws are used for connecting the chassis unit, but the same advantages can also be obtained with a connecting configuration using welding, caulking, etc.

Third Embodiment

The first embodiment has been described with regard to a configuration wherein the side guide members 28 and 29 are fixed to bent faces of the base chassis 10, but the same advantages can be obtained by configuring a positioning part on the positioning abutting face 10*f* (shown in FIGS. 1, 3, and 4) of the base chassis 10 for connecting the side plates.

Fourth Embodiment

The first embodiment has been described with regard to a configuration wherein a DC motor is used for driving the transporting roller 14, but the same advantages can also be obtained with a configuration using a stepping motor.

Figure 11:
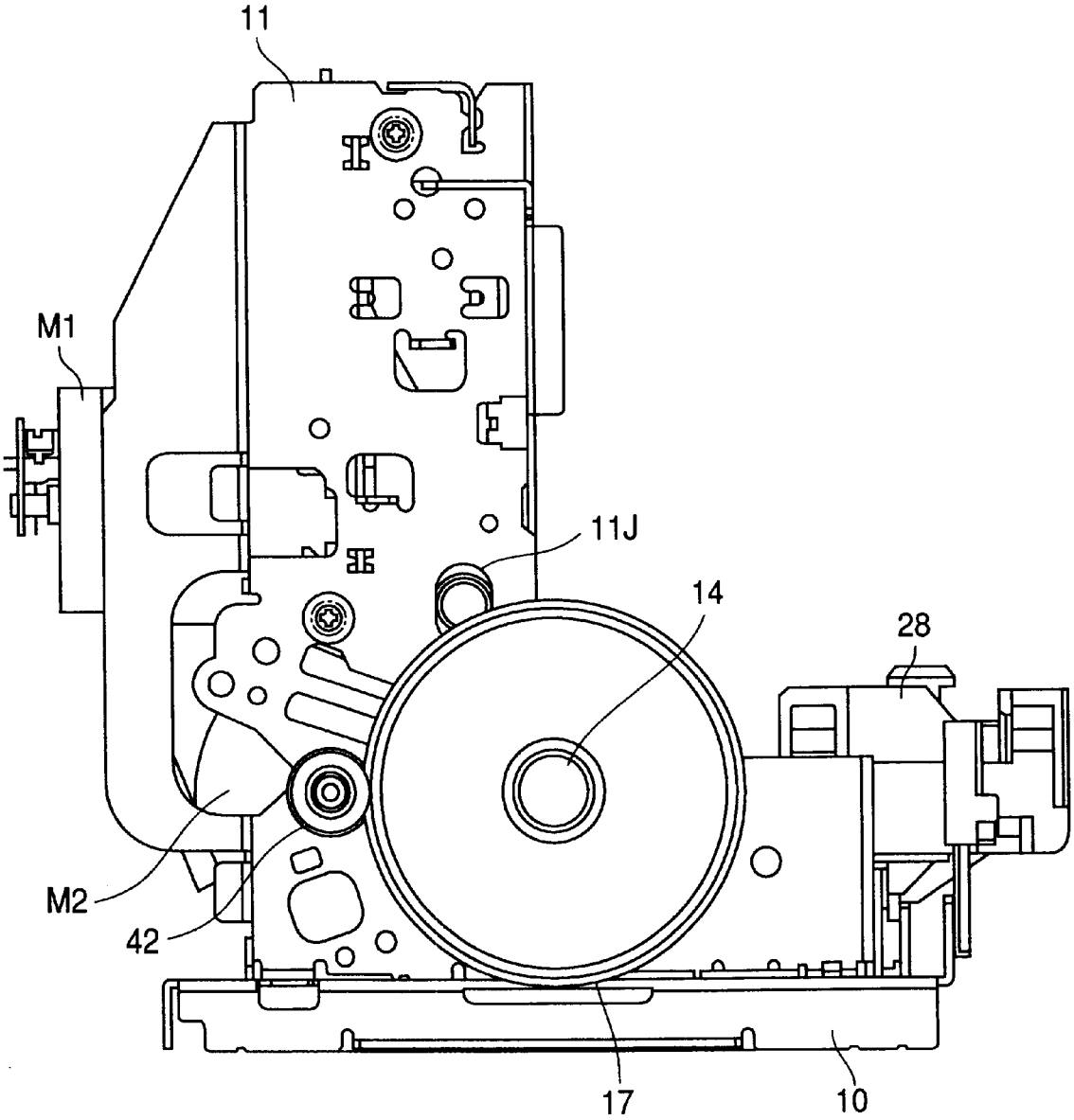
FIG. 11 is a left side view of another embodiment.
Figure 12:
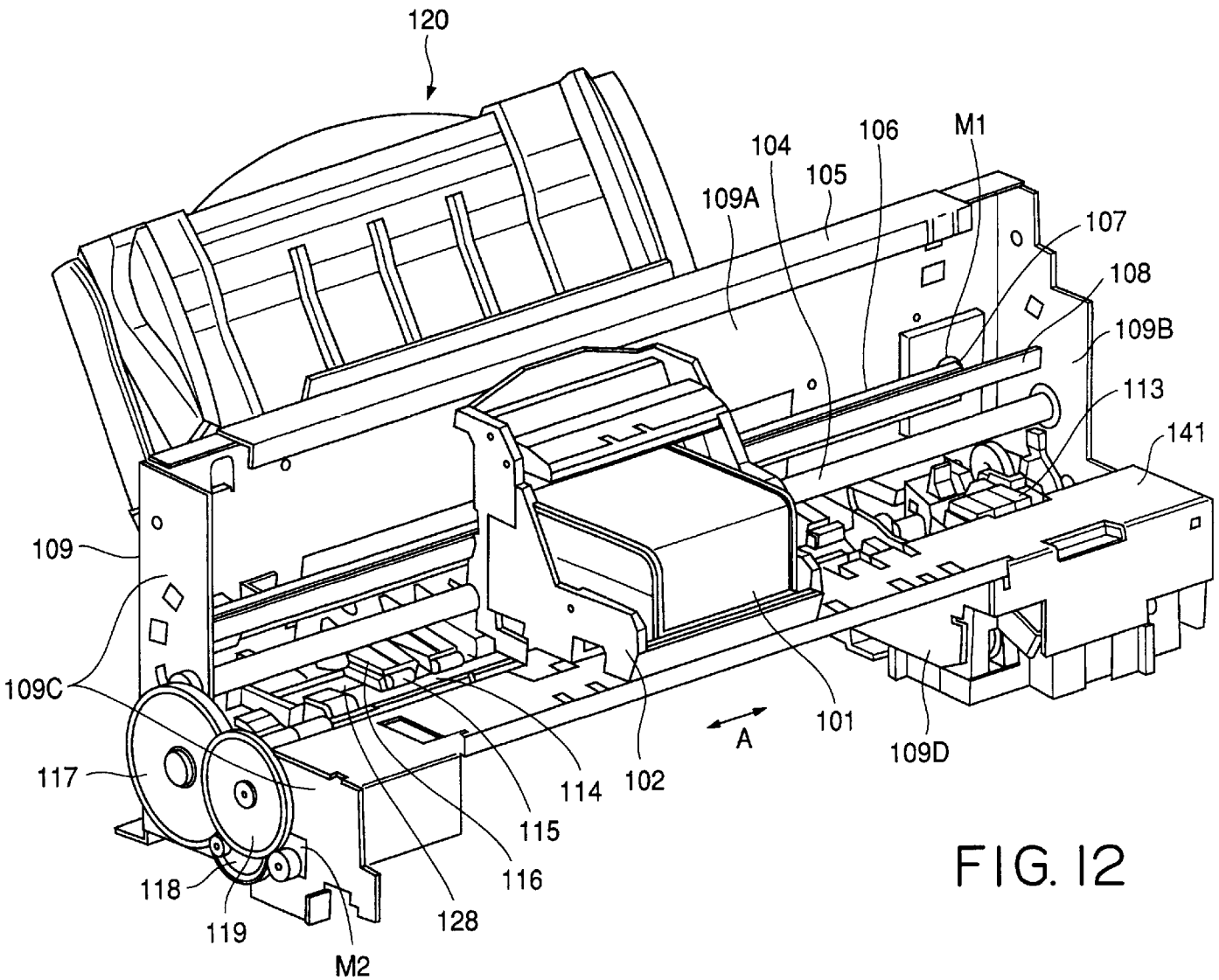
FIG. 12 is a perspective view illustrating a conventional ink-jet recording apparatus.

The fourth embodiment will be described with reference to FIG. 11. A transporting driving gear 17 is fixed to the end of the transporting roller 14, and driving force is transmitted from the motor gear 42 of the transporting motor M2. The transporting motor M2 is positioned and fixed to the left side plate 11. Other details thereof are the same as those of the first embodiment.

Any driving motor will suffice for the transporting motor 14 as long as the driving motor transmits rotational force, and an ultrasonic motor or the like may be used, as well. Also, a configuration may be used wherein different left side plates 11 are modified according to differences in the driving configuration, so as to handle different driving configurations by replacing the left side plate 11. Further, the left side plate 11 may be configured so as to handle both DC motor driving and stepping motor driving.

As described above, two or more different types of transporting driving sources can be attached to the side plate, so individual driving systems can be configured with the same side plate, thereby facilitating standardization of the chassis unit, and reduction of the costs of parts, assembly, and management can be realized.

Fifth Embodiment

As for another configuration, providing the sheet guide attached to the base chassis 10, the transporting roller holding member, and/or the recovery unit with a stopper part, which is a reinforcing member for preventing deformation of the base chassis 10 in the direction toward the chassis 3, for the purpose of preventing deformation of the base chassis 10 due to impact if the apparatus is dropped, enables stable precision to be maintained even if the apparatus is dropped.

Description will be made with reference to FIG. 1, regarding a configuration wherein a stopper part is provided for the first sheet guide member 29. A stopper member (protrusion) 29G, which abuts a bent face 3*a* on the lower side of the chassis 3 in the event the base chassis 10 is deformed in the direction toward the chassis 3, is formed on the first sheet guide member 29. The same advantages can be obtained by providing stopper parts for the transporting roller holding member, recovery unit, and so forth.

Sixth Embodiment

The first embodiment has been described with regard to a configuration wherein the first sheet guide member 29 and the second sheet guide member 28 are positioned and fixed to the base chassis 10, but a configuration may also be made wherein a third sheet guide member for performing holding of the recording sheet at the time of discharging the recording sheet from the discharging roller 31 is positioned and fixed to the base chassis 10.

Also, the sheet guide members may each be individually positioned and fixed to the base chassis 10 as separate parts, or may be configured integrally and thus positioned and fixed.

According to the present embodiments described above, the image recording unit and the parts of the sheet transporting system including the sheet guide members are positioned on the same faces of the side plates, so the image recording unit and the parts of the sheet transporting system can be relatively positioned with high precision. Also, the distance between the recording head and the recording face of the recording sheet is maintained with high precision in particular, so images with higher quality that that with conventional arrangements can be obtained by recording apparatuses to which the present invention has been applied.

Also, the base chassis 10 positions the sheet guide members, thereby increasing rigidity of the sheet guide members at the time of mounting, and the positional precision of the sheet guide members can be maintained over the entire width direction of the sheet.

Also, the side plates can be separated from the base chassis 10, and further from the chassis 3, so the side plates can be standardized while exchanging the chassis and base chassis in products accommodating different sheet widths.

Also, in the event that the sheet feeding driving system differs, the side plates may be exchanged and the chassis and base chassis can be standardized, thereby reducing the costs of parts, assembly, and management, and making a series of products and handling improved versions of products can be realized with few changes in parts.

Also, packing and shipping efficiency of parts is improved by providing separate parts, so transporting and handling management costs can be reduced. Further, the configuration of abutting, connecting and fixing the chassis and base chassis with side plates enables the rigidity of the overall chassis to be improved with a simple configuration.

Also, the recovery unit is also positioned and fixed to the base chassis, so the recording head, cleaning unit, and capping unit can be relatively positioned with high precision.

Also, the side plates are capable of positioning and fixing different types of transporting driving sources for driving the sheet transporting system, so different driving systems can be mounted on the same side plate, thereby realizing standardization of the chassis unit, and reducing the costs of parts, assembly, and management.

Also, the side plates position the carriage and the position detecting unit for detecting the position of the carriage, so they can be relatively positioned with high precision.

Also, providing reinforcing material between the base chassis 10 and the chassis 3 allows the relation between the recording head and the recording face of the sheet to be maintained with high precision, even if the main unit is dropped.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A recording apparatus for recording on a recording medium with a recording head, said recording apparatus comprising:

a base chassis;

a transporting member for transporting the recording medium;

a carriage for mounting the recording head;

a guide member for guiding said carriage;

a carriage motor for effecting movement of said carriage;

a second chassis for holding said carriage motor;

two side plates connected to opposite ends of said base chassis across a transporting path of the recording medium transported by said transporting member;

first positioning parts, disposed on a predetermined face of each of said two side plates, for positioning said side plates on said base chassis;

second positioning parts, disposed on the predetermined face of each of said two side plates, for positioning said guide member on said side plates;

a third positioning part, disposed on one of said two side plates, for positioning said transporting member on at least the one of said side plates;

fourth positioning parts, disposed on the predetermined face of each of said two side plates, for positioning said second chassis on said side plates; and a fifth positioning part, disposed on said base chassis, for positioning said transporting member on said base chassis.

2. A recording apparatus according to claim 1, wherein said carriage moves in a width direction of the recording medium.

3. A recording apparatus according to claim 1, wherein said transporting member comprises one of:

a transporting roller for transporting the recording medium to a position facing the recording head; and a discharging roller for discharging the recording medium upon which an image has been recorded by the recording head.

4. A recording apparatus according to claim 3, further comprising:

an inlet sheet guide member for guiding the recording medium to said transporting roller; and an additional positioning part disposed on said base chassis, for positioning said inlet sheet guide member on said base chassis.

5. A recording apparatus according to claim 4, wherein said additional positioning part is provided plural in number and the plurality of said additional positioning parts are disposed on a same face of said base chassis.

6. A recording apparatus according to claim 5, wherein the same face of said base chassis is a bent face formed by cutting and raising a portion of a flat plate forming said base chassis.

7. A recording apparatus according to claim 3, further comprising:

an intermediate sheet guide member for guiding the recording medium from said transporting roller to said discharging roller; and an additional positioning part disposed on said base chassis, for positioning said intermediate sheet guide member on said base chassis.

8. A recording apparatus according to claim 7, wherein said additional positioning part is provided plural in number and the plurality of said additional positioning parts are disposed on a same face of said base chassis.

9. A recording apparatus according to claim 8, wherein the same face of said base chassis is a bent face formed by cutting and raising a portion of a flat plate forming said base chassis.

10. A recording apparatus according to claim 3, further comprising:

a discharge sheet guide member for guiding the recording medium discharged by said discharging roller; and an additional positioning part disposed on said base chassis, for positioning said discharge sheet guide member on said base chassis.

11. A recording apparatus according to claim 10, wherein said additional positioning part is provided plural in number and the plurality of said additional positioning parts are disposed on a same face of said base chassis.

12. A recording apparatus according to claim 11, wherein the same face of said base chassis is a bent face formed by cutting and raising a portion of a flat plate forming said base chassis.

13. A recording apparatus according to claim 1, further comprising:

a transporting motor for driving said transporting member; and an additional positioning part disposed on one of said side plates, for positioning said transporting motor on the one of said side plates.

14. A recording apparatus according to claim 13, wherein a configuration of said additional positioning part is determined by the type of said transporting motor.

15. A recording apparatus according to claim 14, wherein said transporting motor is one of a stepping motor, a DC motor, and an ultrasonic motor.

16. A recording apparatus according to claim 1, wherein the recording head records on the recording medium by discharging ink, and wherein a recovery unit for performing recovery processing of the recording head is positioned on said base chassis.

17. A recording apparatus according to claim 16, wherein the recording head applies electric energy to electrothermal converters in accordance with recording signals, and discharges the ink using thermal energy generated by the electrothermal converters.

18. A recording apparatus for recording on a recording medium with a recording head, said recording apparatus comprising:

a base chassis;

a conveying roller for conveying the recording medium;

a guide member for guiding the recording head in main scanning directions;

a scanning motor for effecting movement of the recording head;

a second chassis for holding said scanning motor;

first and second side plates separate from said base chassis, said first and second side plates being connectable to opposite sides of said base chassis;

means for connecting and relatively positioning said first and second side plates to the opposite sides of said base chassis;

means for connecting and relatively positioning said guide member to said first and second side plates;

means for connecting and relatively positioning said conveying roller to at least one of said first and second side plates;

means for positioning said second chassis on said first and second side plates; and means for positioning said conveying roller on said base chassis.

19. An apparatus according to claim 18, wherein said means for connecting and relatively positioning said first side plate to said base chassis comprises at least one pair of a projection and a receiving hole.

20. An apparatus according to claim 19, wherein said means for connecting and relatively positioning said first side plate to said base chassis further comprises a screw.

21. An apparatus according to claim 18, wherein said means for connecting and relatively positioning said guide member to said first side plate comprises a projection and a receiving hole.

22. An apparatus according to claim 18, wherein said means for connecting and relatively positioning said conveying roller to said at least one side plate comprises a receiving groove.

23. An apparatus according to claim 18, wherein said base chassis is of a configuration for accommodating the size of said guide member or conveying roller.

24. An apparatus according to claim 23, wherein said first and second side plates are of predetermined configurations, regardless of the configuration of said base chassis.

25. An apparatus according to claim 18, wherein at least one of said first and second side plates is of a configuration for accommodating a particular component.

26. An apparatus according to claim 25, wherein said base chassis is of a predetermined configuration, regardless of the configuration of said at least one of said first and second side plates.

27. An apparatus according to claim 18, further comprising means for connecting and relatively positioning said scanning motor to said second chassis.

28. An apparatus according to claim 27, wherein said means for positioning said second chassis to said first side plate comprises at least one pair of a projection and a receiving hole.

29. An apparatus according to claim 28, wherein said means for positioning said second chassis to said first side plate further comprises a screw.

* * * * *